US008991380B2

(12) United States Patent
Bednar et al.

(10) Patent No.: US 8,991,380 B2
(45) Date of Patent: Mar. 31, 2015

(54) BARREL CABLE SUPPRESSOR

(71) Applicant: Hunter's Manufacturing Company, Inc., Suffield, OH (US)

(72) Inventors: Richard L. Bednar, Munroe Falls, OH (US); Jacob A. Hout, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 14/188,874

(22) Filed: Feb. 25, 2014

(65) Prior Publication Data

US 2014/0165982 A1 Jun. 19, 2014

Related U.S. Application Data

(62) Division of application No. 12/984,827, filed on Jan. 5, 2011, now Pat. No. 8,656,899.

(60) Provisional application No. 61/293,251, filed on Jan. 8, 2010.

(51) Int. Cl.

| | |
|---|---|
| ***F41B 5/20*** | (2006.01) |
| ***F41B 5/12*** | (2006.01) |
| ***F41B 5/00*** | (2006.01) |
| *F41B 5/14* | (2006.01) |

(52) U.S. Cl.

CPC . *F41B 5/12* (2013.01); *F41B 5/123* (2013.01); *F41B 5/1407* (2013.01); *F41B 5/1426* (2013.01)

USPC ..... 124/89; 124/25; 124/86; 124/88

(58) Field of Classification Search

CPC ..... F41B 5/1426; F41B 5/123; F41B 5/12; F41B 5/1407

USPC ..... 124/25, 86, 88, 89, 90, 92

See application file for complete search history.

(56) References Cited

U.S. PATENT DOCUMENTS

| | | | | | |
|---|---|---|---|---|---|
| 3,483,857 | A * | 12/1969 | Jones | 124/25 |
| 3,486,495 | A | 12/1969 | Allen | |
| 4,060,066 | A | 11/1977 | Kudlacek | |
| 4,716,880 | A | 1/1988 | Adkins | |
| 4,827,893 | A * | 5/1989 | Nishioka | 124/25 |
| 4,947,822 | A * | 8/1990 | Jones et al. | 124/41.1 |
| 5,062,406 | A * | 11/1991 | Robertson | 124/25 |
| 5,119,797 | A * | 6/1992 | Anderson | 124/25 |
| 5,362,046 | A * | 11/1994 | Sims | 473/300 |
| 5,437,260 | A * | 8/1995 | King | 124/25 |
| 5,553,596 | A * | 9/1996 | Bednar | 124/25 |
| 6,298,842 | B1 * | 10/2001 | Sims | 124/89 |
| 6,543,432 | B2 * | 4/2003 | Andrews et al. | 124/23.1 |
| 6,758,205 | B2 * | 7/2004 | Kronfeld | 124/89 |
| 6,966,314 | B2 * | 11/2005 | McPherson | 124/89 |
| 7,178,514 | B2 * | 2/2007 | Chang | 124/25 |
| 7,328,693 | B2 * | 2/2008 | Kempf | 124/25 |
| 7,455,059 | B2 * | 11/2008 | Shaffer | 124/25 |
| 7,624,724 | B2 * | 12/2009 | Bednar et al. | 124/25 |

(Continued)

*Primary Examiner* — Melba Bumgarner
*Assistant Examiner* — Alexander Niconovich
(74) *Attorney, Agent, or Firm* — Emerson Thomson Bennett

(57) ABSTRACT

A grip guard may be used with a crossbow that has a main beam including a stock and a barrel. The grip guard may have a first wall that is positioned between the stock and the barrel and a second wall that extends outwardly from the main beam. The first wall may have dampening properties to attenuate sounds and vibrations caused by firing the crossbow and the second wall may prevent a user's fingers from inadvertently extending from the handle toward the barrel.

12 Claims, 7 Drawing Sheets

(56) References Cited

U.S. PATENT DOCUMENTS

| | | | | |
|---|---|---|---|---|
| 7,703,449 | B2 * | 4/2010 | Wright | 124/89 |
| 7,938,108 | B2 * | 5/2011 | Popov et al. | 124/25 |
| RE42,842 | E | 10/2011 | McPherson | |
| 8,033,275 | B2 * | 10/2011 | Bednar et al. | 124/25 |
| 8,061,339 | B2 * | 11/2011 | Shaffer | 124/25 |
| 8,141,548 | B2 * | 3/2012 | Leven | 124/89 |
| 8,225,777 | B2 * | 7/2012 | Chu | 124/25 |
| 8,336,533 | B2 * | 12/2012 | Bach et al. | 124/92 |
| 8,365,713 | B2 * | 2/2013 | Grace, Jr. | 124/89 |
| 8,656,899 | B2 * | 2/2014 | Bednar et al. | 124/25 |
| 2003/0136392 | A1 * | 7/2003 | McPherson | 124/25.6 |
| 2009/0133683 | A1 | 5/2009 | Wright | |
| 2009/0178657 | A1 * | 7/2009 | Shaffer | 124/25 |
| 2011/0271938 | A1 * | 11/2011 | Chu | 124/25 |
| 2012/0006311 | A1 * | 1/2012 | Bednar et al. | 124/25 |

* cited by examiner

BARREL CABLE SUPPRESSOR

This divisional patent application claims priority from U.S. patent application Ser. No. 12/984,827 filed Jan. 5, 2011, entitled BARREL CABLE SUPPRESSOR, which will issue as U.S. Pat. No. 8,656,899 on Feb. 25, 2014, which claims priority to U.S. Provisional Patent Application No. 61/293,251 filed Jan. 8, 2010, entitled BARREL CABLE SUPPRESSOR, both of which are incorporated herein by reference.

I. BACKGROUND

A. Field of the Invention

This invention pertains to the art of methods and apparatuses of crossbow devices, specifically, to the art of methods and apparatuses of devices for reducing vibrations and noise resulting from the firing of a crossbow device.

B. Description of Related Art

Crossbows have been used for many years as a weapon for hunting and fishing, and for target shooting. In general, a crossbow includes a main beam including a stock member and a barrel connected to the stock member. The barrel typically has an arrow receiving area for receiving the arrow that is to be shot. The crossbow includes a bow assembly supported on the main beam that includes a bow and a bowstring connected to the bow for use in shooting arrows. A trigger for mechanism, also supported on the main beam, holds the bowstring in a drawn or cocked condition and can thereafter be operated to release the bowstring to shoot the arrow.

The crossbow may include a compound bow assembly having cams, eccentrics, or wheels rotatably attached to the distal ends of the distal ends of the bow limbs. The cams may receive the bowstring and typically act to reduce the amount of force required to draw the bowstring and/or may increase the amount of force provided by the crossbow. Another method for increasing the amount of force provided by the crossbow includes utilizing one or more barrel cables that may be received by the cams and coupled to the ends of the bow limbs. Drawing the bowstring may cause the cables to pull the bow limbs generally inward toward the main beam of the crossbow. The cams may rotate about an axis as the bowstring is drawn. As the cams rotate, the cables may be caused to travel across at least a portion of the cams thereby causing the bow limbs to be pulled generally inward.

To prevent the cables from interfering with the projection of the arrow, the cables extend through a cable slot formed in the barrel of the crossbow. The movement of the bow limbs towards and away from the main beam as the bowstring is drawn and released causes the cables to move along the longitudinal axis of the main beam within the cable slot. Commonly, to reduce wear and friction, the cables will extend through a cable slide positioned within the cable slot. Drawing the crossbow causes potential energy to be stored in the bow limbs as the limbs are bent or flexed inward. Releasing the bowstring from the drawing position causes the potential energy stored in the limbs to be transferred to the bowstring and cables. Typically, the transferred energy is used to propel and arrow or bolt from the crossbow. Upon propelling the arrow or bolt, energy transferred to the bowstring and/or cables and not used to propel the arrow or bolt can cause the bowstring and/or cables to vibrate. These vibrations result in unwanted noise that is both too loud (as measured in decibels) and too long in duration.

II. SUMMARY

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The barrel cable suppressor may be positioned at least partially within a cable slot formed in the barrel member. The barrel cable suppressor may at least partially attenuate vibrations and noise caused by the release of the bowstring.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The bow assembly may further comprise a first cam, a second cam, a first cable, and a second cable. The first cam may be operatively connected to the first limb to rotate about a first axle. The second cam may be operatively connected to the second limb to rotate about a second axle. The bowstring may be received by the first and second cams such that the drawing of the bowstring causes the first and second cams to rotate in a first direction. The first cable may be operatively connected to the first limb, may extend through the cable slot, and may be received by the second cam. The second cable may be operatively connected to the second limb, may extend through the cable slot, and may be received by the first cam. The rotation of the first and second cams in the first direction may cause the first and second limbs to be pulled generally inward towards the main beam. The first and second cables may contact at least a portion of the barrel cable suppressor when the bowstring is released from the trigger mechanism. The barrel cable suppressor may be positioned at least partially within a cable slot formed in the barrel member. The barrel cable suppressor may at least partially attenuate vibrations and noise caused by the release of the bowstring.

According to one embodiment of the invention, a recurve crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The barrel cable suppressor may be positioned at least partially within a cable slot formed in the barrel member. The barrel cable suppressor may at least partially attenuate vibrations and noise caused by the release of the bowstring.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The barrel cable suppressor may be positioned at least partially within a cable slot formed in the barrel member. The barrel cable suppressor may at least partially attenuate vibrations and noise caused by the release of the bowstring. The barrel cable suppressor may comprise a cable dampener.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The bow assembly may further comprise a first cam, a second cam, a first cable, and a second cable. The first cam may be operatively connected to the first limb to rotate about a first axle. The second cam may be operatively connected to the second limb to rotate about a second axle. The bowstring may be received by the first and second cams such that the drawing of the bowstring causes the first and second cams to rotate in a first direction. The first cable may be operatively connected to the first limb, may extend through the cable slot, and may be received by the second cam. The second cable may be operatively connected to the second limb, may extend through the cable slot, and may be received by the first cam. The rotation of the first and second cams in the first direction may cause the first and second limbs to be pulled generally inward towards the main beam. The first and second cables may contact at least a portion of the barrel cable suppressor when the bowstring is released from the trigger mechanism. The barrel cable suppressor may be positioned at least partially within a cable slot formed in the barrel member. The barrel cable suppressor may at least partially attenuate vibrations and noise caused by the release of the bowstring. The barrel cable suppressor may comprise a cable damper. The first or the second cable may contact at least a portion of the cable dampener when the bowstring is released from the trigger mechanism.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam. The bowstring may extend between the first and second limbs. The bow assembly may further comprise a first cam, a second cam, a first cable, and a second cable. The first cam may be operatively connected to the first limb to rotate about a first axle. The second cam may be operatively connected to the second limb to rotate about a second axle. The bowstring may be received by the first and second cams such that the drawing of the bowstring causes the first and second cams to rotate in a first direction. The first cable may be operatively connected to the first limb, may extend through the cable slot, and may be received by the second cam. The second cable may be operatively connected to the second limb, may extend through the cable slot, and may be received by the first cam. The rotation of the first and second cams in the first direction may cause the first and second limbs to be pulled generally inward towards the main beam. The first and second cables may contact at least a portion of the barrel cable suppressor when the bowstring is released from the trigger mechanism. The barrel cable suppressor may be positioned at least partially within a cable slot formed in the barrel member. The barrel cable suppressor may at least partially attenuate vibrations and noise caused by the release of the bowstring. The barrel cable suppressor may comprise a cable damper. The first or the second cable may contact at least a portion of the cable dampener when the bowstring is released from the trigger mechanism. The cable dampener may comprise a hollow construction that allows the cable dampener to at least partially compress or deform when contacted by the first or second cable.

According to one embodiment of the invention, a method may comprise the steps of providing a crossbow; drawing a bowstring; releasing the bowstring; and attenuating vibrations caused by the releasing of the bowstring. The provided crossbow may comprise a main beam having a stock member and a barrel member; a trigger mechanism mounted to the main beam for selectively retaining and releasing a bowstring; a bow assembly comprising a first limb and a second limb, wherein the first limb and the second limb extend transversely from a distal end of the main beam and the bowstring extends between the first and second limbs; and, a barrel cable suppressor positioned at least partially within a cable slot formed in the barrel member. The barrel cable suppressor may at least partially cause the attenuation of the vibrations.

According to one embodiment of the invention, a method may comprise the steps of providing a crossbow; drawing a bowstring; releasing the bowstring; attenuating vibrations caused by the releasing of the bowstring; and, contacting at least a portion of a barrel cable suppressor with a first cable or a second cable when the bowstring is released. The provided crossbow may comprise a main beam having a stock member and a barrel member; a trigger mechanism mounted to the main beam for selectively retaining and releasing a bowstring; a bow assembly comprising a first limb and a second limb, wherein the first limb and the second limb extend transversely from a distal end of the main beam and the bowstring extends between the first and second limbs; and, a barrel cable suppressor positioned at least partially within a cable slot formed in the barrel member. The barrel cable suppressor may at least partially cause the attenuation of the vibrations. The first cable may be operatively connected to the first limb, may extend through the cable slot, and may be received by a first cam that is operatively connected to the second limb. The second cable may be operatively connected to the second limb, may extend through the cable slot, and may be received by a second cam operatively connected to the first limb.

According to one embodiment of the invention, a method may comprise the steps of providing a crossbow; drawing a bowstring; releasing the bowstring; attenuating vibrations caused by the releasing of the bowstring; contacting at least a portion of a barrel cable suppressor with a first cable or a second cable when the bowstring is released and, deforming at least a portion of a cable dampener. The provided crossbow may comprise a main beam having a stock member and a barrel member; a trigger mechanism mounted to the main beam for selectively retaining and releasing a bowstring; a bow assembly comprising a first limb and a second limb, wherein the first limb and the second limb extend transversely from a distal end of the main beam and the bowstring extends between the first and second limbs; and, a barrel cable suppressor positioned at least partially within a cable slot formed in the barrel member. The barrel cable suppressor may at least partially cause the attenuation of the vibrations. The first cable may be operatively connected to the first limb, may extend through the cable slot, and may be received by a first cam that is operatively connected to the second limb. The second cable may be operatively connected to the second limb, may extend through the cable slot, and may be received by a second cam operatively connected to the first limb. The cable dampener may comprise a hollow construction and may be at least partially positioned within the cable slot. The deformation of at least a portion of the cable dampener may be at least partially caused by the cable dampener being contacted by the first or the second cable.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam and the bowstring may extend between the first and second limbs. The barrel cable suppressor may be positioned on the first limb or the second limb. The barrel cable suppressor may at least partially attenuate vibrations and noise caused by the release of the bowstring.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam and the bowstring may extend between the first and second limbs. The barrel cable suppressor may be positioned on the first limb or the second limb. The barrel cable suppressor may at least partially attenuate vibrations and noise caused by the release of the bowstring. The barrel cable suppressor may comprise a cable dampener. At least a portion of the cable dampener may be contacted by a first cable, a second cable, or the bowstring when the bowstring is released from a drawn position.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam and the bowstring may extend between the first and second limbs. The barrel cable suppressor may be positioned on the first limb or the second limb. The barrel cable suppressor may at least partially attenuate vibrations and noise caused by the release of the bowstring. The barrel cable suppressor may comprise a cable dampener comprising a plurality of appendages. At least a portion of one of the plurality of appendages may be contacted by a first cable, a second cable, or the bowstring when the bowstring is released from a drawn position.

According to one embodiment of the invention, a crossbow may comprise a main beam, a trigger mechanism, a bow assembly, and a barrel cable suppressor. The main beam may have a stock member and a barrel member. The trigger mechanism may be mounted to the main beam for selectively retaining and releasing a bowstring. The bow assembly may comprise a first limb and a second limb. The first limb and the second limb may extend transversely from a distal end of the main beam and the bowstring may extend between the first and second limbs. The barrel cable suppressor may be positioned on the first limb or the second limb. The barrel cable suppressor may at least partially attenuate vibrations and noise caused by the release of the bowstring. The barrel cable suppressor may comprise a cable dampener comprising a plurality of appendages and a dampener mass. At least a portion of one of the plurality of appendages may be contacted by a first cable, a second cable, or the bowstring when the bowstring is released from a drawn position. The dampener mass may be positioned adjacent to each distal end of each of the plurality of appendages.

One advantage of this invention is the reduction or attenuation of unwanted vibrations and noise caused by the barrel cables when firing an arrow from the crossbow.

Another advantage of this invention is that it may be retrofit to an existing crossbow.

Yet another advantage of this invention is that it may be utilized with any type of crossbow including a compound crossbow and a recurve crossbow.

Still other benefits and advantages of the invention will become apparent to those skilled in the art to which it pertains upon a reading and understanding of the following detailed specification.

IV. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

V. DETAILED DESCRIPTION

Figure 1:
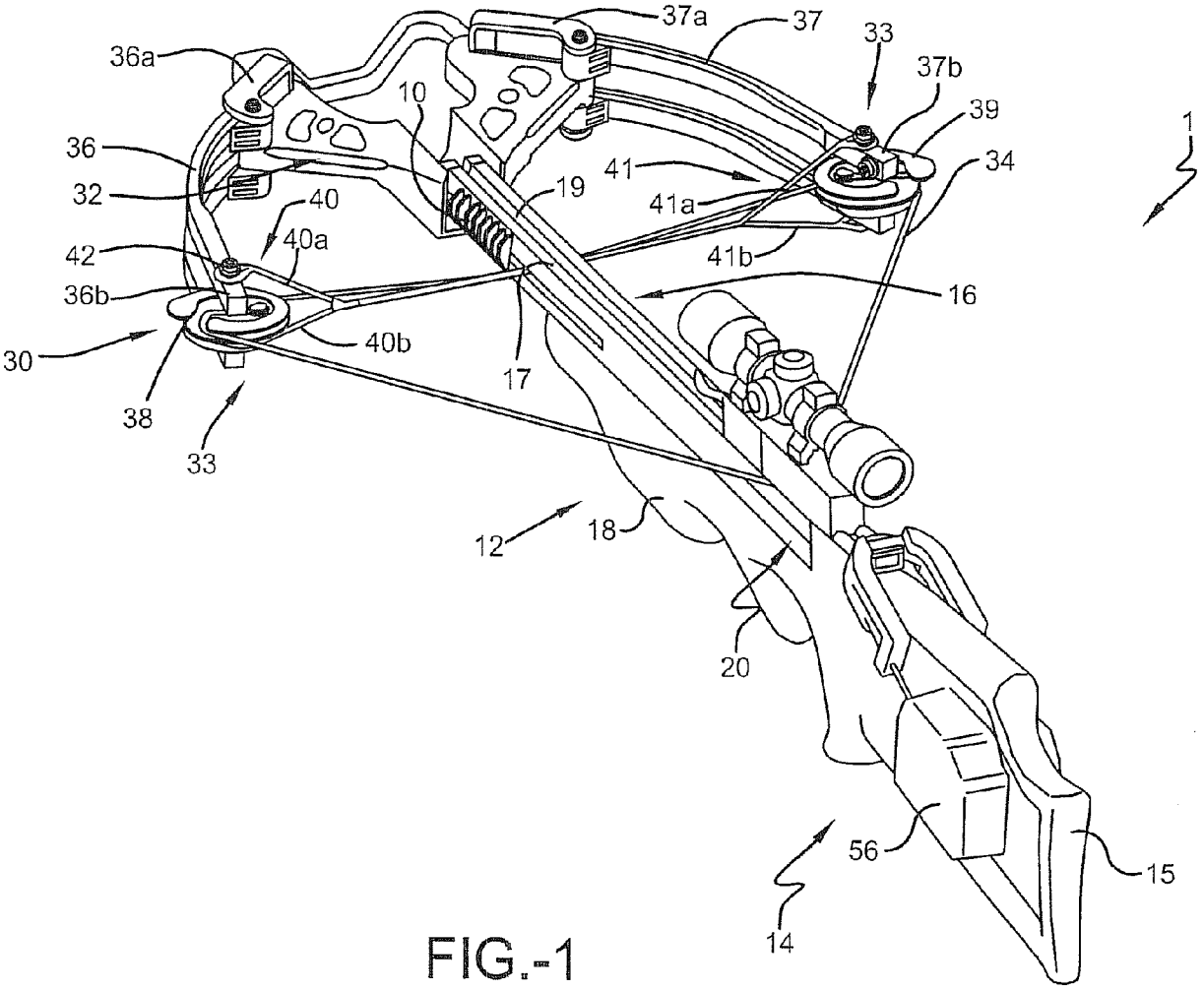
FIG. 1 shows an angled, top, perspective view of a crossbow device comprising a barrel cable suppressor according to one embodiment of the invention.
Figure 2:
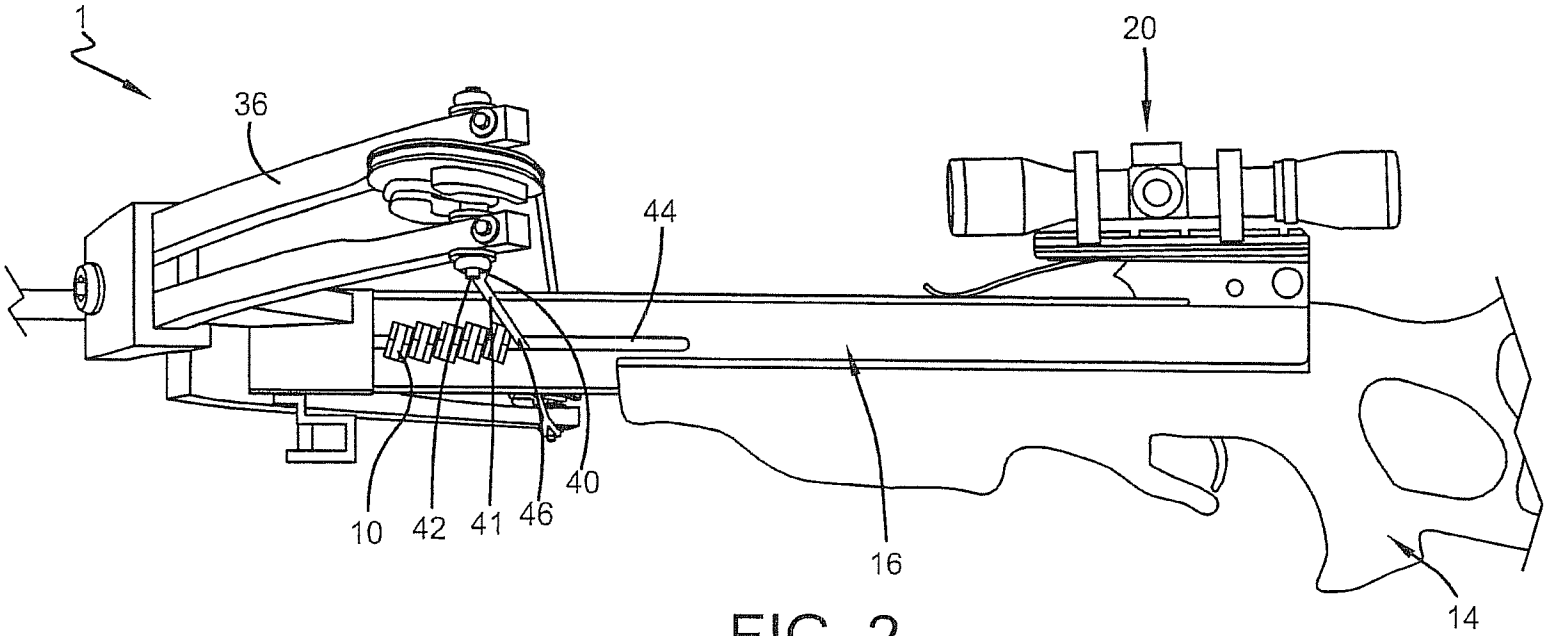
FIG. 2 shows a side perspective view of the crossbow device shown in FIG. 1.
Figure 3:
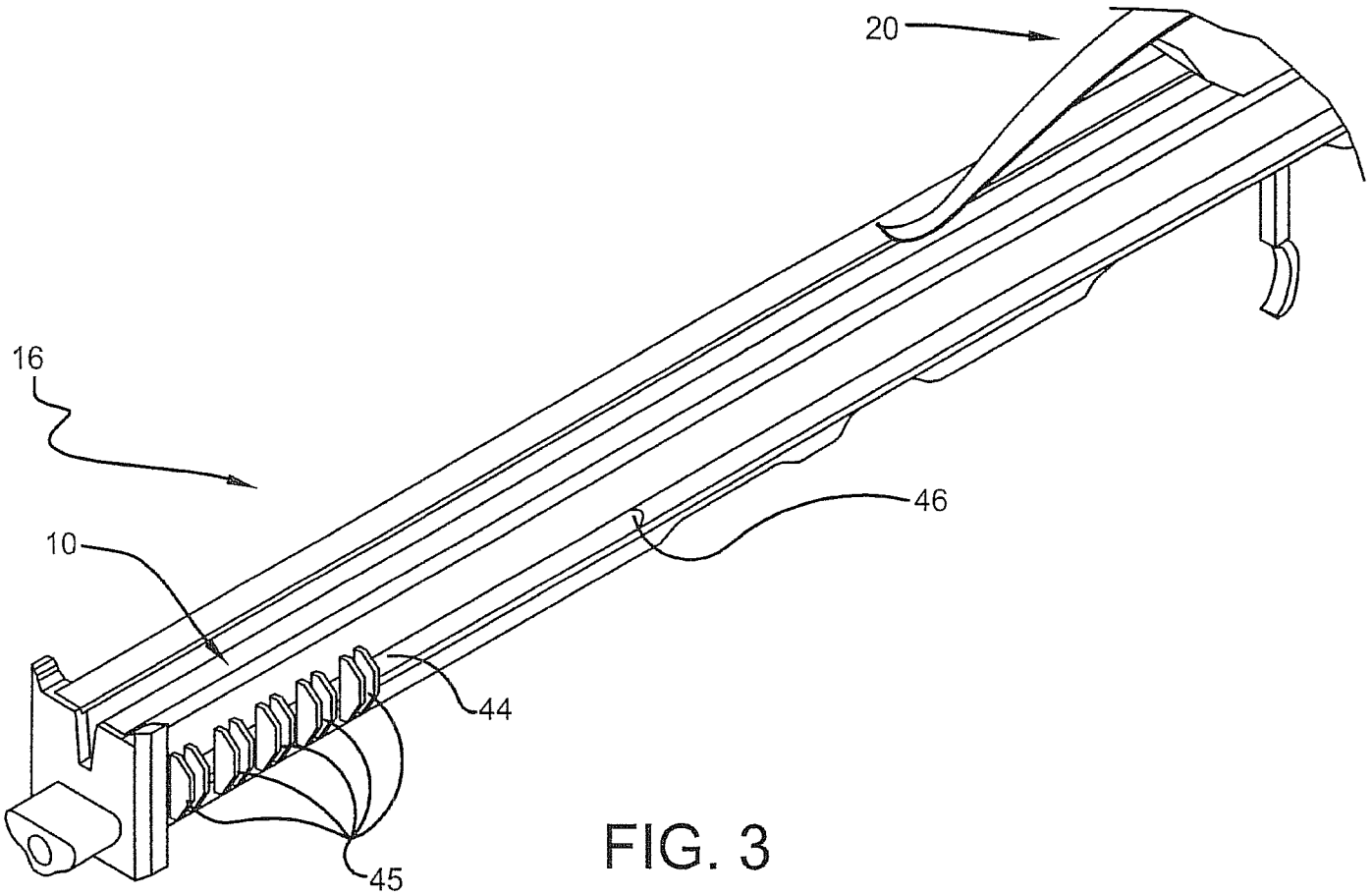
FIG. 3 shows a partial perspective view showing a portion of the barrel and the barrel cable suppressor of the crossbow device shown in FIG. 1.

Referring now to the FIGURES wherein the showings are for purposes of illustrating multiple embodiments of the invention only and not for purposes of limiting the same, FIGS. 1-3 show a crossbow 1 having a barrel cable suppressor 10 according to one embodiment of the invention. The crossbow 1 may comprise a main beam 12, a trigger mechanism 20, and a bow assembly 30. The main beam 12 may comprise a stock member 14 and a barrel member 16. In one embodiment, the stock member 14 and the barrel member 16 may comprise separate components that are operatively connected to form the main beam 12. The stock member 14 may comprise a member that is placed against a shoulder of a user when firing an arrow from the crossbow 1. The barrel member 16 may be coupled to the stock member 14 and may comprise an elongated member that extends generally parallel with a desired flight pattern of the arrow to be propelled or fired from the crossbow 1. The barrel member 16 may comprise an upper surface 17 having a channel 19 formed therein. The channel 19 may receive a member of the arrow's fletching and may act as a guide to assist in directing the arrow from the crossbow 1.

A handgrip 18 may be mounted to the main beam 12 in any conventional manner chosen with sound judgment by a person of ordinary skill in the art. The trigger mechanism 20 may be mounted to the main beam 12. The trigger mechanism 20 may be a mechanism that is suitable for selectively retaining and releasing a bowstring 34 as is well known in the art. The trigger mechanism 20 may comprise any type of trigger mechanism and may be mounted to the main beam 12 in any suitable manner chosen with sound judgment by a person of ordinary skill in the art.

With reference now to FIG. 1, the bow assembly 30 may be coupled to the distal end of the main beam 12. The bow assembly 30 may comprise a bow portion 32, a cam assembly 33, and the bowstring 34. The bow portion 32 may include a first limb 36 and a second limb 37. The first and second limbs 36, 37 may each comprise a first end 36*a*, 37*a* and a second end 36*b*, 37*b* respectively. The first ends 36*a*, 37*a* may be operatively connected to the end of the main beam 12 such that the first and second limbs 36, 37 extend transversely thereto in opposite directions generally away from the main beam 12. The first and second limbs 36, 37 may comprise a single member or two or more separate members each operatively connected to the crossbow 1. In one embodiment, the bow assembly 30 may include a riser or block 40 for operatively connecting the first and second limbs 36, 37 to the crossbow 1. The riser 40 may comprise a pair of limb pockets that receive the first and second limbs 36, 37. The first and second limbs 36, 37 may be operatively connected to the riser 40 utilizing any method chosen with sound judgment by a person of ordinary skill in the art.

With continued reference now to FIG. 1, the cam assembly 33 may comprise a first cam 38, a second cam 39, a first barrel cable 40, and a second barrel cable 41 The first and second cams 38, 39 may be operatively connected to the second ends 36*b*, 37*b* of the first and second limbs 36, 37, respectively. In one embodiment, the first cam 38 may be operatively connected to the second end 36*b* to rotate about an axle 42. The second cam 39 may be operatively connected to the second end 37*b* to rotate about an axle 43. The first and second cams 38, 39 may receive the bowstring 34 and may rotate about axles 42, 43 in a first direction as the bowstring 34 is drawn rearward and in a second direction, opposite to the first direction as the bowstring 34 is released. In one embodiment, the first and second cam assemblies 38, 39 may comprise oblong or eccentric shaped pulley mechanisms over which the bowstring 34 travels as it is drawn and released. Once the bowstring 34 is drawn past a predetermined point rearward towards a butt portion 15 of the stock member 14, the first and second cams 38, 39 may serve to minimize the force that must be imparted on the bowstring 34 to maintain the bowstring 34 in this drawn position. Similarly, as the bowstring 34 is released and passes a predetermined point in the forward direction generally away from the butt portion 15 of the stock member 14, the first and second cams 38, 39 may provide a mechanical advantage that serves to enhance the force with which the arrow is propelled from the crossbow 1. Although a particular cam assembly having a particular cam is shown, any type of cam assembly and/or cam, chosen with sound judgment by a person of ordinary skill in the art, may be used.

With reference now to FIGS. 1 and 2, the first and second cables 40, 41 may extend between the second ends 36*b*, 37*b* of the first and second limbs 36, 37. The first cable 40 may comprise first and second ends 40*a*, 40*b* that are operatively connected to the second end 36*b* of the first limb 36. In one embodiment, the first and second ends 40*a*, 40*b* may be operatively connected to the axle 42. The first cable 40 may be received by the second cam 39 such that the rotation of the second cam 39 in the first direction causes the first cable 40 to travel over the second cam 39. The second cable 41 may comprise first and second ends 41*a*, 41*b* that are operatively connected to the second end 37*b* of the second limb 37. The second cable 41 may be received by the first cam 38 such that the rotation of the first cam 38 in the first direction causes the second cable 41 to travel over the first cam 38. The traveling of the first and second cables 40, 41 across the first and second cams 38, 39, respectively, decreases the effective length of the first and second cables 40, 41 thereby causing the first and second limbs 36, 37 to be flexed or pulled inward generally towards the main beam 12 thereby enhancing the force with which the arrow is propelled from the crossbow 1 by causing the amount of potential energy stored in the first and second limbs 36, 37 to be increased. The first and second cables 40, 41 may pass through a cable slot 44, shown in FIG. 2, formed in the barrel member 16. In one embodiment, a cable slide 46 may be positioned within the cable slot 44. The first and second cables 40, 41 may extend through an aperture formed in the cable slide 46. The cable slide 46 may at least partially facilitate the movement of the first and second cables 40, 41 within the cable slot 44. The drawing and releasing of the bowstring 34 may cause the first and second limbs 36, 37 to be flexed or pulled generally inward toward the main beam 12 as the bowstring 34 is drawn and then moved away from the main beam 12 as the bowstring 34 is released as is well known in the art. The movement of the first and second limbs 36, 37 as the bowstring 34 is drawn and released may cause the movement of the first and second cables 40, 41 within the cable slot 44.

With reference now to FIGS. 1-3, according to one embodiment, the barrel cable suppressor 10 may be positioned at least partially within the cable slot 44. The barrel cable suppressor 10 may increase the general dampening properties of the crossbow 1 and provide for sound and vibration attenuation by reducing or substantially preventing the vibration of the first and second cables 40, 41. As stated above, the drawing of the bowstring 34 and the subsequent flexing of the first and second limbs 36, 37 cause potential energy to be stored therein. As the bowstring 34 is released, a portion of the energy stored in the first and second limbs 36, 37 may be transferred to the first and second cables 40, 41. The barrel cable suppressor 10 may absorb at least a portion of the energy transferred to the first and second cables 40, 41. In one embodiment, the barrel cable suppressor 10 may be positioned within the cable slot 44 such that the movement of the first and second cables 40, 41 resulting from the rotation of the first and second cams 38, 39 in the second direction causes the first cable 40, the second cable 41, and/or the cable slide 46 to contact at least a portion of the barrel cable suppressor 10 thereby increasing the dampening properties of the crossbow 1 and at least partially attenuating any resultant sound or vibration caused by the firing of the crossbow 1.

With continued reference now to FIGS. 1-3, in one embodiment, the barrel cable suppressor 10 may comprise a cable dampener 45. The cable damper 45 may comprise a composition suitable for absorbing vibrational energy from the first and second cables 40, 41 that results from the firing of the arrow from the crossbow 1. The cable dampener 45 may comprise any material that provides sound and vibration absorption properties. In one embodiment, the cable damper 45 may comprise a rubber composition. The cable damper 45 may be constructed to allow, increase, and/or maximize the ability of the material comprising the cable damper 45 to function as intended. In one embodiment, the cable damper 45 may comprise a hollow construction to allow the material to compress and deform as the material absorbs vibrations and transferred energy. The cable dampener 45 may comprise any composition, material, or construction chosen with sound judgment by a person of ordinary skill in the art.

With continued reference now to FIGS. 1-3, the cable dampener 45 may be positioned at least partially within the cable slot 44. In one embodiment, with the bowstring 34 relaxed or not drawn, the cable dampener 45 may be positioned to contact or abut the first cable 40, the second cable 41, and/or the cable slide 46. As the bowstring 34 is drawn, the first cable 40, the second cable 41, and/or the cable slide 46 may move away from the cable dampener 45. In one embodiment, the first cable 40, the second cable 41, and/or the cable slide 46 may move such that the first cable 40, the second cable 41, and/or the cable slide 46 no longer contacts or abuts the cable dampener 45. Upon release of the bowstring 34, the first cable 40, the second cable 41, and/or the cable slide 46 may contact at least a portion of the cable dampener 45 thereby allowing at least a portion of the energy transferred from the first and second limbs 36, 37 to be transferred to and absorbed by the cable dampener 45. In one embodiment, the barrel cable suppressor 10 may comprise a plurality of cable dampeners 45 that are selectively positionable within the cable slot 44. In another embodiment, the barrel cable suppressor 10 may comprise a single cable dampener 45 that is selectively positionable within the cable slot 44.

With continued reference now to FIGS. 1-3, the barrel cable suppressor 10 may be selectively inserted within the cable slot 44 of a conventional crossbow thereby allowing for the retrofitting of existing crossbows with the barrel cable suppressor 10. The barrel cable suppressor 10 may be friction fitted within at least a portion of the cable slot 44. In another embodiment, the barrel cable suppressor 10 may be attached to the barrel 16 using conventional fasteners, such as, for example, conventional screws, or adhesive such as, for example, double-sided tape. The conventional fastener may allow the barrel cable suppressor 10 to be retro-fit to an existing crossbow and/or installed by the manufacturer. In another embodiment, the barrel cable suppressor 10 may be co-molded with the barrel 16. For one non-limiting example, the barrel 16 may be placed inside a steel mold and a rubber or material having similar properties and/or composition may be molded overtop of the barrel 16.

Figure 4:
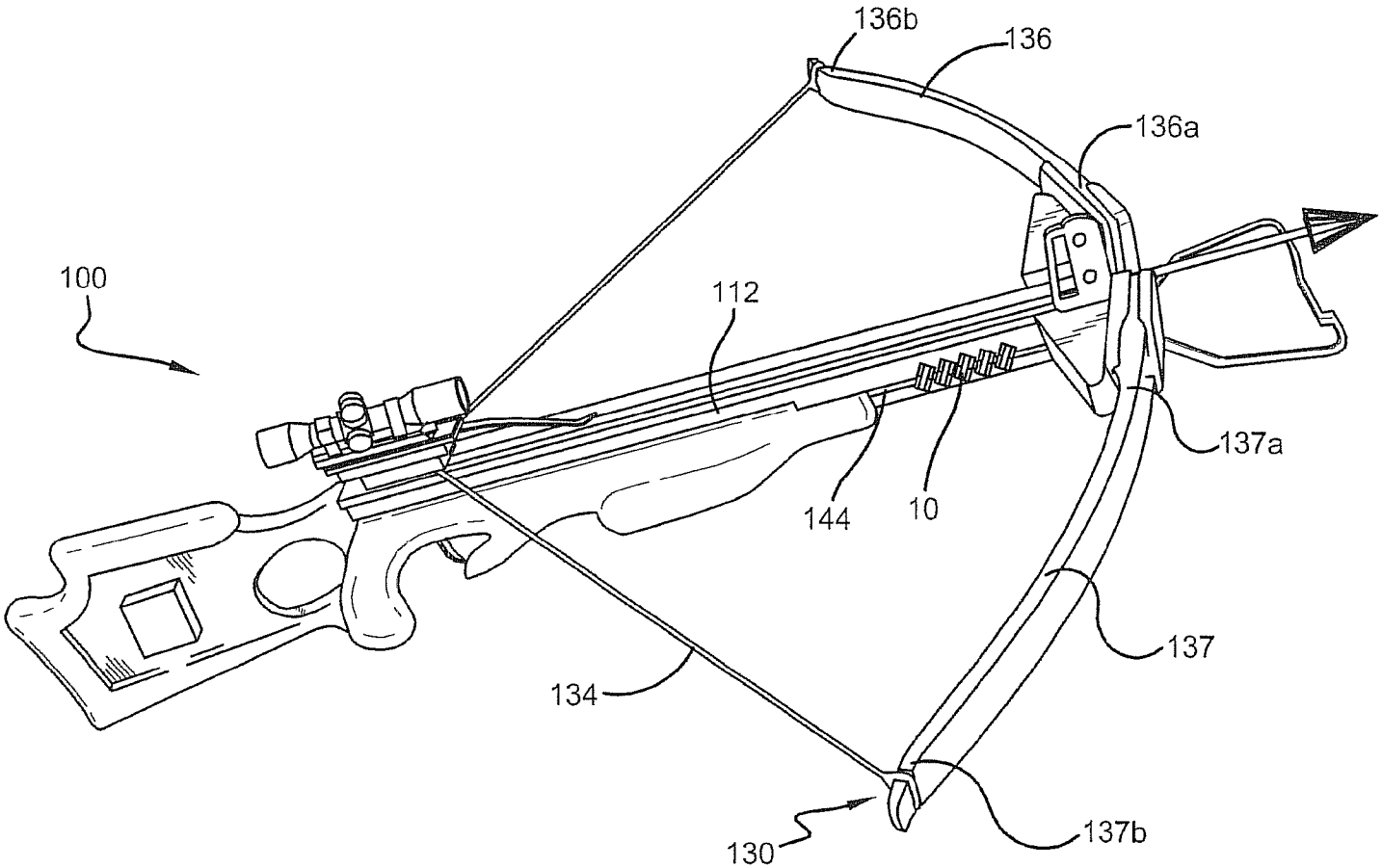
FIG. 4 shows an angled side perspective view of a recurve crossbow device comprising a barrel cable suppressor according to one embodiment of the invention.
Figure 5:
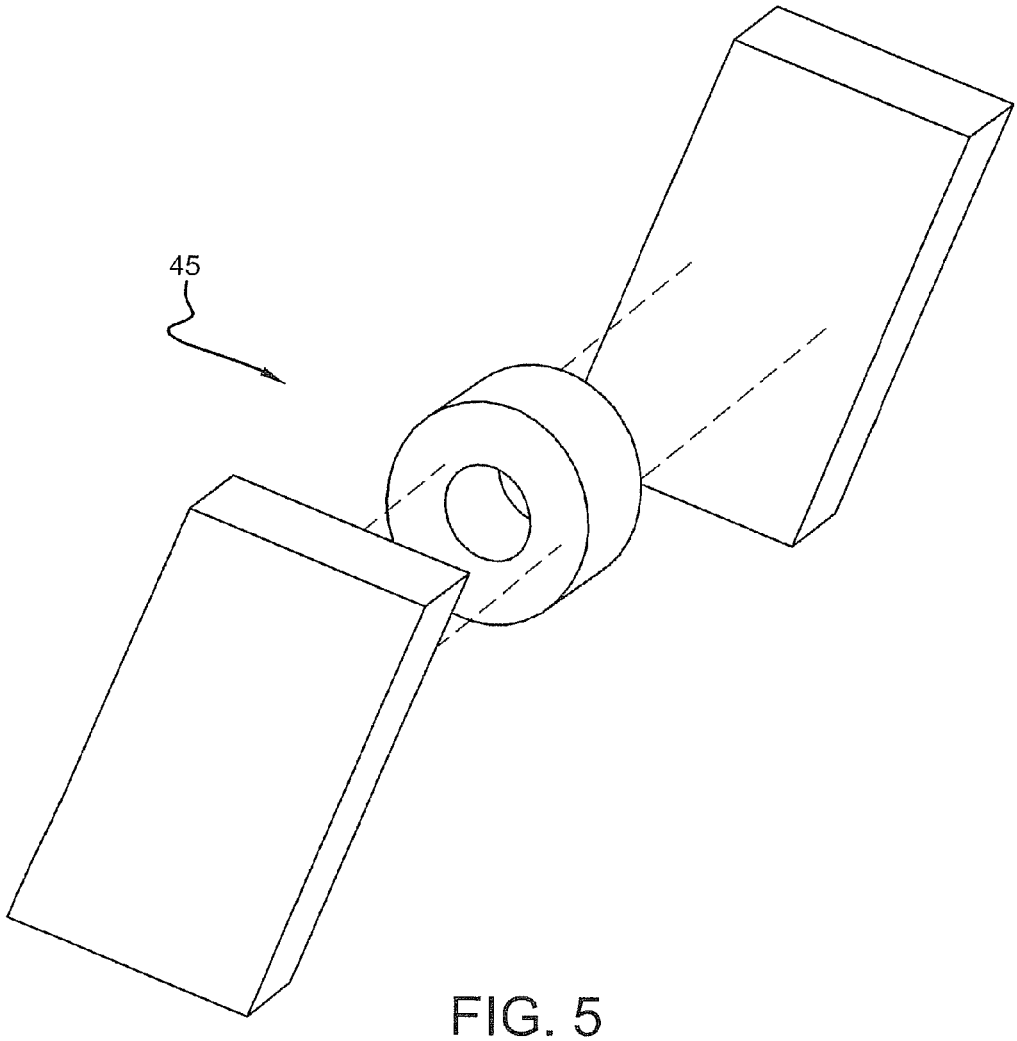
FIG. 5 shows an assembly view of a cable dampener according to one embodiment of the invention.

With reference now to FIGS. 1-4, in one embodiment, the barrel cable suppressor 10 may be used with a recurve crossbow 100, shown in FIG. 4. The recurve crossbow 100 may comprise a bow assembly 130 be coupled to the distal end of a main beam 112. The bow assembly 130 may comprise a bow portion 132 and a bowstring 134. The bow portion 132 may include a first limb 136 and a second limb 137. The first and second limbs 136, 137 may each comprise a first end 136*a*, 137*a* and a second end 136*b*, 137*b* respectively. The first ends 136*a*, 137*a* may be operatively connected to the end of the main beam 112 such that the first and second limbs 136, 137 extend transversely thereto in opposite directions generally away from the main beam 112. The bowstring 134 may be operatively connected to the second ends 136*b*, 137*b*. In one embodiment, the bowstring 134 may be coupled to the second ends 136*b*, 137*b* by a first and second loop, not shown, formed on opposing ends of the bowstring 134. The barrel cable suppressor 10 may be positioned at least partially within a cable slot 144 formed in the main beam 112. The barrel cable suppressor 10 may provide the crossbow 100 with increased dampening properties and result in a greater attenuation of sound and vibration when firing the crossbow 100.

Figure 6:
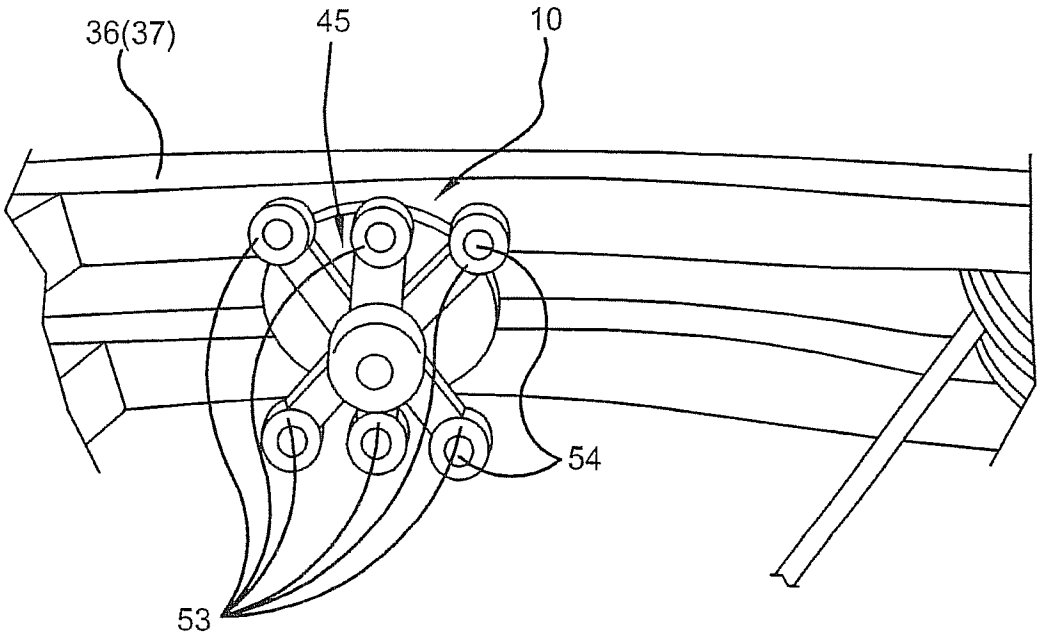
FIG. 6 shows a front perspective view of a cable suppressor positioned within a limb of a crossbow according to one embodiment of the invention.
Figure 7:
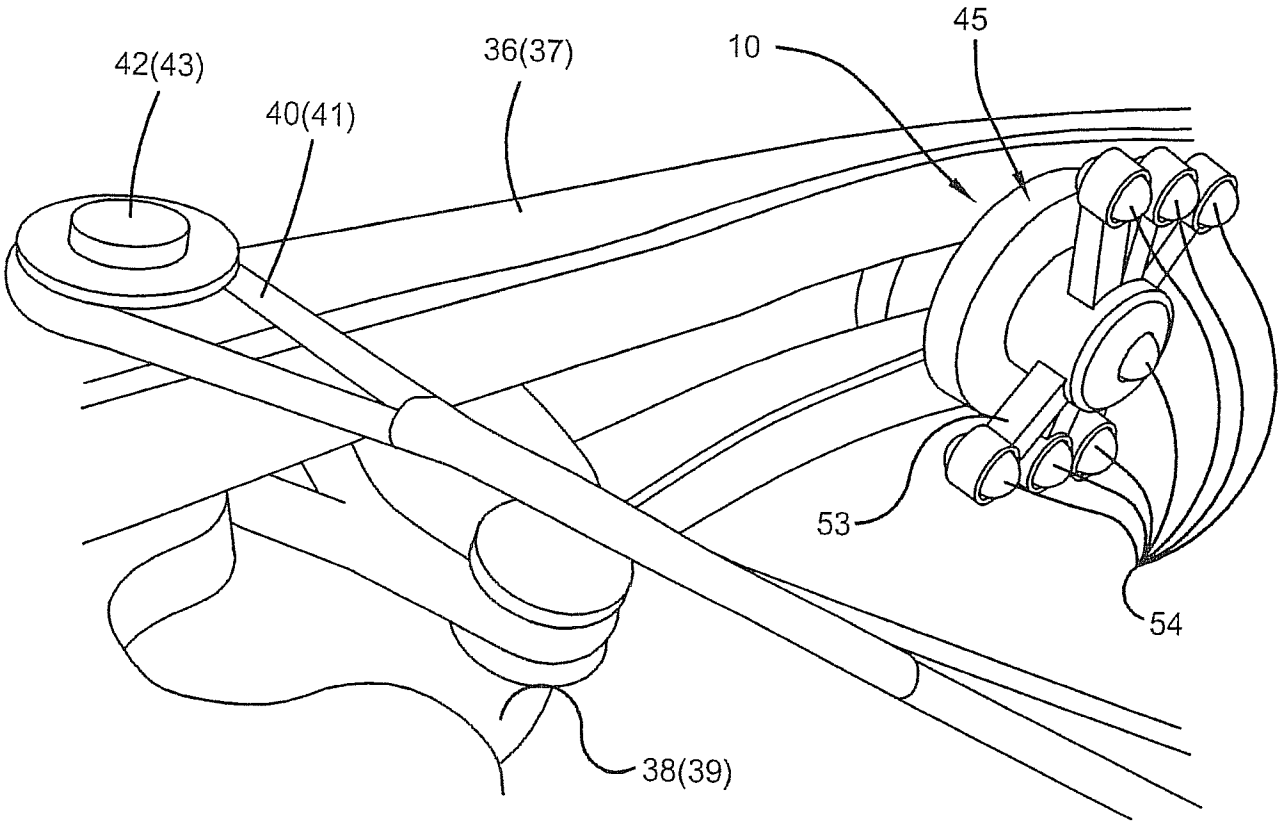
FIG. 7 shows an angled side perspective view of the cable suppressor shown in FIG. 6.

With reference now to FIGS. 1, 6, and 7, in one embodiment, the barrel cable suppressor 10 may be coupled to the first limb 36 and/or the second limb 37. The barrel cable suppressor 10 may be positioned such that upon firing the crossbow 1 the first cable 40, the second cables 41, and/or the bowstring 34 contact at least a portion of the barrel cable suppressor 10. In one embodiment, the barrel cable suppressor 10 may comprise a two-piece design that can be selectively coupled to the first limb 36 and/or the second limb 37. The barrel cable suppressor 10 may comprise a means for causing the individual pieces comprising the barrel cable suppressor 10 to be selectively interlocked or combined. In one embodiment, the barrel cable suppressor 10 may comprise a plurality of threads position on one piece of the barrel cable suppressor 10 and a plurality of corresponding grooves positioned on the other. The plurality of threads and grooves may allow the barrel cable suppressor 10 to be selectively positioned on the first limb 36 and/or the second limb 37. In another embodiment, the first and second limbs 36, 37 may each comprise a split limb assembly and a first barrel cable suppressor 10 may be positioned to extend between the two limb portions of the first limb 36 and a second barrel cable suppressor 10 may be positioned to extend between the two limb portions of the second limb 37. The first and second barrel cable suppressors 10 may extend through the two limb portions of the first and second limbs 36, 37, respectively, such that a portion of the first and second barrel cable suppressors 10 abut opposing sides of the first and second limbs 36, 37 thereby substantially fixedly positioning the first and second barrel cable suppressors 10. In one embodiment, the first and second barrel cable suppressors 10 may each include the cable dampener 45. The cable dampener 45 may comprise a plurality of appendages 53 suitable for absorbing energy transferred by the first cable 40, the second cable 41, and/or the bowstring 34, such as, for example, a rubber composition. The cable dampener 45 may be positioned on the first limb 36 and/or the second limb 37 such that the release of the bowstring 34 from the drawn position causes at least a portion of one of the plurality of appendages 53 to be contacted by the first cable 40, the second cable 41, and/or the bowstring 34. In one embodiment, each of the appendages 53 may comprise a dampener mass 54 positioned adjacent to the distal end of the appendage 53. Additionally, the cable dampener 45 may comprise a dampener mass 54 positioned substantially at the center of the cable dampener 45. The dampener mass 54 may comprise a weight or mass intended to increase amount of transferred energy the barrel cable suppressor 10 is able to absorb.

With reference now to the FIGURES, a method for attenuating vibrations and noise caused by firing the crossbow will generally be described. According to one embodiment, the crossbow 1 may be provided to an associated user. As described above, the provided crossbow 1 may comprise the main beam 12 having the stock member 14 and the barrel member 16; the trigger mechanism 20; the bow assembly 30; and, the barrel cable suppressor 10. The trigger mechanism 20 may be mounted to the main beam 12 for selectively retaining and releasing the bowstring 34. The bow assembly 30 may comprise the first limb 36 and the second limb 37 that extend transversely from the distal end of the main beam 12. The bowstring 34 may extend between the first and second limbs 36, 37. The barrel cable suppressor 10 may be positioned at least partially within the cable slot 44 formed in the barrel member 16. The bowstring 34 may be drawn and can be selectively retained by the trigger mechanism 20. The bowstring 34 may be released. In one embodiment, a bolt or arrow, not shown, may be positioned to be fired from the crossbow 1, and the bowstring 34 may be released by actuating a trigger lever, not shown. Releasing the bowstring 34 may cause at least a portion of the potential energy stored in the first and second limbs 36, 37 to be transferred to the bowstring 34 to propel the arrow, not shown, from the crossbow 1 and may result in producing vibrations and noise. The vibrations and/or noise caused by the release of the bowstring 34 may be attenuated. In one embodiment, the barrel cable suppressor 10 may at least partially cause the attenuation of the vibrations and/or noise.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

Having thus described the invention, it is now claimed.

We claim:

1. A method comprising the steps of:

(A) providing a crossbow comprising: (1) a main beam having a stock member and a barrel member, wherein the barrel member comprises a cable slot; (2) a bow assembly comprising: (a) first and second limbs that extend transversely from a distal end of the main beam; (b) a bowstring that extends between the first and second limbs; and, (c) a first cable that extends between the first and second limbs and within the cable slot and, (3) a trigger mechanism that: (a) is mounted to the main beam; and, (b) selectively retains and releases the bowstring;

(B) providing a barrel cable suppressor positioned substantially within the cable slot;

(C) drawing the bowstring until it is retained by the trigger mechanism;

(D) releasing the bowstring with the trigger mechanism and contacting the first cable to at least a portion of the barrel cable suppressor; and, (E) attenuating at least some vibrations and noise caused by the releasing of the bowstring with the first cable contacting the barrel cable suppressor.

2. The method of claim 1 wherein step (A) comprises the step of:

providing the crossbow to be a recurve crossbow.

3. The method of claim 1 wherein step (B) comprises the step of:

providing the barrel cable suppressor with a cable dampener formed of a composition suitable for absorbing vibrational energy.

4. The method of claim 3 wherein step (B) comprises the step of:

providing the cable dampener to be formed of a composition that comprises rubber.

5. The method of claim 3 wherein step (B) comprises the step of:

providing the cable dampener to comprise a hollow construction that allows the composition to compress and deform as it absorbs vibrational energy.

6. The method of claim 1 wherein:

step (A) comprises the step of: providing the bow assembly with a cam assembly comprising: (1) a first cam that is operatively connected to the first limb to rotate about a first axle; (2) a second cam that is operatively connected to the second limb to rotate about a second axle, wherein the bowstring is received by the first and second cams; (3) the first cable which is operatively connected to the first limb, extends through the cable slot, and is received by the second cam; and, (4) a second cable that is operatively connected to the second limb, extends through the cable slot, and is received by the first cam;

step (C) comprises the step of: rotating the first and second cams in a first direction to cause the first and second limbs to be pulled generally inward towards the main beam;

step (D) comprises the step of: contacting the second cable to at least a portion of the cable suppressor; and, step (E) comprises the step of: attenuating at least some vibrations and noise caused by the releasing of the bowstring with the second cable contacting the barrel cable suppressor.

7. The method of claim 1 wherein step (B) comprises the steps of: positioning a cable slide having an aperture within the cable slot; and, receiving the first cable within the aperture.

8. The method of claim 1 wherein the first cable does not contact the cable suppressor when the bowstring is not released from the trigger mechanism.

9. The method of claim 1 wherein step (B) comprises the steps of:

providing the cable slot with proximal and distal ends where the proximal end of the cable slot is closer to the trigger mechanism than the distal end; and, positioning the cable suppressor at the distal end of the cable slot.

10. The method of claim 1 wherein step (B) comprises the steps of:

providing the cable suppressor to extend completely through the cable slot.

11. The method of claim 10 wherein step (B) comprises the steps of:

providing the cable slot with first and second sides formed on first and second sides of the barrel member; and, providing the cable suppressor to extend outward beyond the first and second sides of the cable slot.

12. The method of claim 1 wherein:

step (A) comprises the steps of: (1) providing the main beam with a riser attached to the distal end of the barrel; and, (2) providing the first and second limbs to extend transversely from the barrel; and, step (B) comprises the step of: positioning the cable suppressor entirely proximal of the riser.

* * * * *